US006136491A

United States Patent [19]

Yamauchi

[11] Patent Number: 6,136,491

[45] Date of Patent: Oct. 24, 2000

[54] DEVELOPING AGENT, IMAGE FORMING APPARATUS AND IMAGE FORMING METHOD

[75] Inventor: Toshiaki Yamauchi, Fujisawa, Japan

[73] Assignee: Toshiba TEC Kabushiki Kaisha, Tokyo, Japan

[21] Appl. No.: 09/526,551

[22] Filed: Mar. 16, 2000

[30] Foreign Application Priority Data

Aug. 11, 1999 [JP] Japan ..... 11-227536

[51] Int. Cl.[7] ..... G03G 9/097

[52] U.S. Cl. ..... 430/110; 430/111; 430/120; 399/252

[58] Field of Search ..... 430/110, 111, 430/120; 399/252

[56] References Cited

U.S. PATENT DOCUMENTS

| | | | |
|---|---|---|---|
| 3,983,045 | 9/1976 | Jugle et al. | 430/110 |
| 4,623,605 | 11/1986 | Kato et al. | 430/110 |
| 4,828,951 | 5/1989 | Kaneko et al. | 430/47 |
| 4,837,101 | 6/1989 | Gruber et al. | 430/110 |
| 5,272,040 | 12/1993 | Nakasawa et al. | 430/111 |
| 5,275,905 | 1/1994 | Ciccarelli et al. | 430/110 |
| 5,506,083 | 4/1996 | Nash et al. | 430/106 |
| 5,776,646 | 7/1998 | Hagi et al. | 430/111 |
| 5,981,132 | 11/1999 | Kurose et al. | 430/110 |
| 6,001,527 | 12/1999 | Ishihara et al. | 430/111 |

*Primary Examiner*—Roland Martin
*Attorney, Agent, or Firm*—Foley & Lardner

[57] ABSTRACT

Titanium oxide, silica having a BET specific surface area of 10 to 50 $m^2/g$, and metal soap having a volume average grain diameter of 1 to 5 $\mu m$ are added to toner particles. With such toner, it becomes possible to stabilize the charge amount and suppress the spent toner, filming and scratches on the photoreceptor, and therefore an image with an excellent reproducibility of half tone, can be obtained at high fineness degree in a later stage in its life.

18 Claims, 1 Drawing Sheet

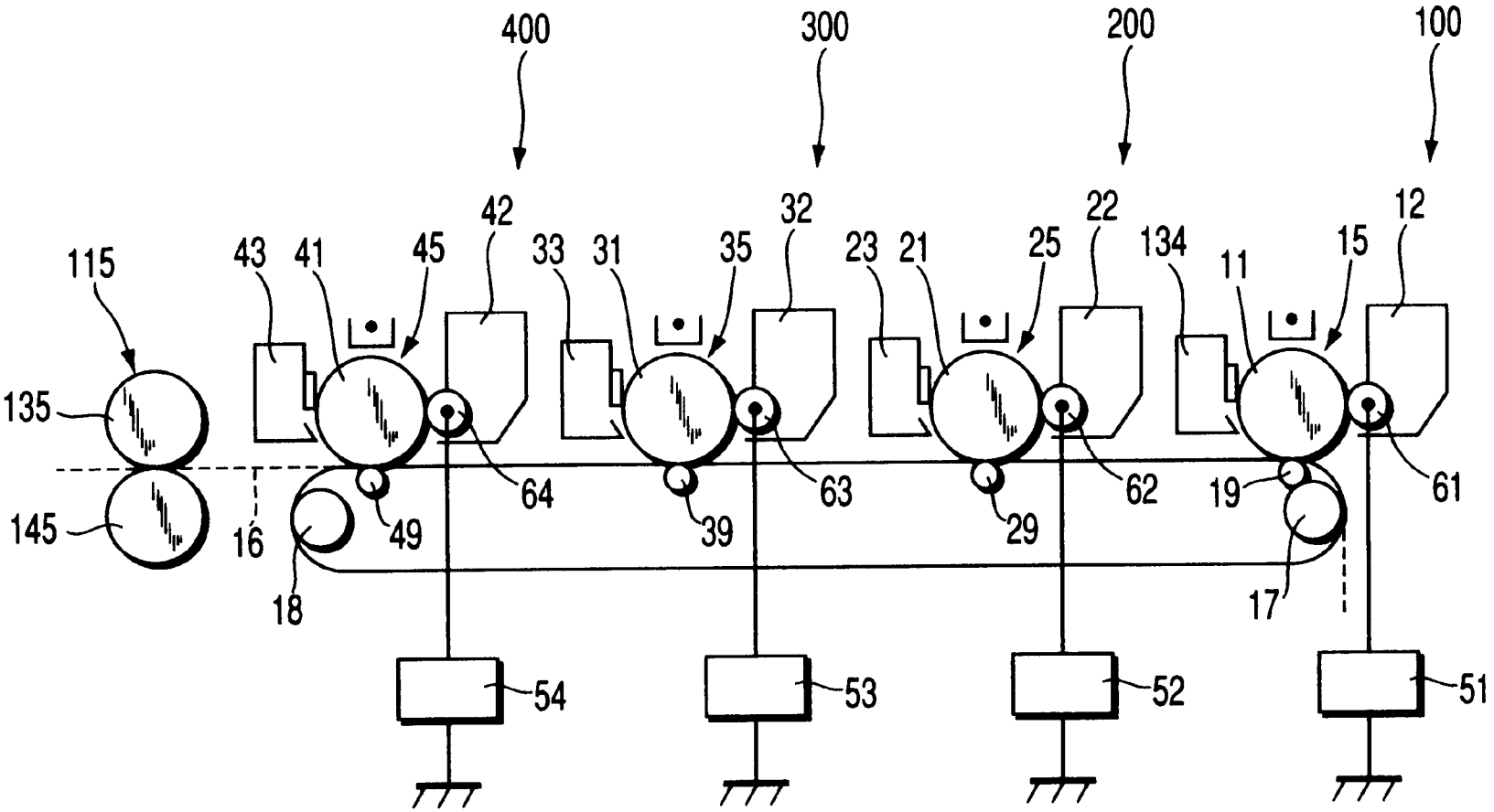
FIGURE

DEVELOPING AGENT, IMAGE FORMING APPARATUS AND IMAGE FORMING METHOD

CROSS-REFERENCE TO RELATED APPLICATIONS

This application is based upon and claims the benefit of priority from the prior Japanese Patent Application No. 11-227536, filed Aug. 11, 1999, the entire contents of which are incorporated herein by reference.

BACKGROUND OF THE INVENTION

The present invention relates to a developing agent used in an electronic photographing apparatus, and more specifically, to a developing agent for forming a color image.

In a full-color electronic photographing process, four colors of toners, that is, yellow, magenta, cyan and black, are developed and fixed, and thus colors including half-tones are generated. In order to reproduce an original accurately, it is required that the four colors of toners should be developed and transferred at high resolution uniformly from a half-tone region to a solid region to form an image, and half-tone colors which are obtained by mixing four colors appropriately could be expressed when fixed.

In order to be able to form a fine image, a higher resolution and a higher uniformity than those of the ordinary monochrome process are required, and in general, finer toner and finer carrier are used.

Further, in a two-component magnetic brush developing method, for a uniform development property, a developing method in which a development bias obtained by a superposition of DC and AC is often used so as to soften a brushing action of the developing agent brush is often employed. It is required that a carrier for the two-component developing agent used in this method, should be of a high resistance for the purpose of avoiding whitening in a filled section caused by leakage, or roughness on surface, or of a low maximum magnetization for the purpose of softening the brushing action.

However, when a carrier having a small particle diameter and a low maximum magnetization is used, the carrier easily adheres to the photoreceptor. Adhered carrier may be stuck between cleaning blades, and thus the photoreceptor drum is scratched, or may be stuck between the photoreceptor and the transfer roller, and thus the transfer roller is scratched. Consequently, there rise problems of disturbing a half tone of an obtained image, or creating a stripe line in a solid portion.

In the meantime, in order to obtain a color tone of a high chroma saturation, it is necessary that the transparency of the toner of each should be high and a uniform fixing surface having less roughness should be obtained. Therefore, for each toner, polyester resin having a low molecular amount, which is generally melted rapidly, is used as binder resin. However, toner which is obtained by using such binder resin has a low mechanical strength, and therefore it is difficult to maintain a sufficient life. The toner which is easy to be melted rapidly has such characteristics that offset easily occurs since the elasticity decreases while being melted. Therefore, conventionally, a mechanism which prevents offset by applying silicon oil on a fixing roller in a steady manner is generally used. However, with this method, oil easily adheres to a print matter to which an image has been fixed. In particular, when an image is fixed on an OHP sheet, there rise problems such as a stripe pattern created on the image with oil and stickiness while sheets are in storage. Further, if an oil supply mechanism is provided, the size of the overall apparatus increases, and it takes an extra work, for example, supplying oil in the tank on a regular schedule.

Under these circumstances, there has been an attempt such that the viscoelasticity does not decrease at a high-temperature state by changing the molecular weight distribution of the resin for the prevention of the offset. However, it is conventionally very difficult to achieve a high transparency of OHP as well as color generating property at the same time. Further, a so-called spent toner occurs, that is, toner sticks to the carrier or developing agent, as the toner becomes old in its life, thereby undesirably deteriorating the development property and image quality. Further, filming, that is, toner adhering to the photoreceptor, occurs undesirably.

Recently, there has been an attempt that a wax having a low melting point is mixed into the toner so as to make it unnecessary to provide an oil supply apparatus for the heat roller, thereby improving the offset property. However, this attempt entails problems of spent toner and the occurrence of filming.

As a method of preventing an increase in spent toner and improving the fluidity of toner, the addition of hydrophobic silica is widely known. However, if a great amount of hydrophobic silica is added so as to obtain a sufficient effect, a new problem that a sufficient ID cannot be obtained due to a high charge amount, arises. Further, additional problems that the difference in charge amount becoming large between a high humidity state and a low humidity state, which is caused by addition of the hydrophobic silica, and the charge amount distribution broadening at low humidity, thus increasing fogging and scattering.

Under these circumstances, a technique of maintaining an initial ID by co-using an inorganic oxide of low resistance, such as titanium oxide, as an additive, is known.

As described above, generally, a great amount of additive is used by controlling the chargeability of color toner and preventing spent toner, in order to prolong the life. However, at the same time, just because of it, the filming on the photoreceptor increases. In particular, silica having a small particle diameter easily adheres to the photoreceptor. In addition, as more toner adheres, a spot or stripe appears on the image as the toner becomes older in its life. Further, resin having a low melting point and a great amount of low-melting point wax are significant cause for the filming.

As measures for preventing filming, a technique of adding polisher such as strontium titanate, cerium oxide, aluminum oxide, silicon nitride or silicon carbide to toner so as to peel off adhered toner, has been widely used. However, with use of such a polisher, scratches on the photoreceptor increase, thus creating a rough image where white stripes and color stripes are resulted in its half tone portion.

Further, with use of the silica having a large particle diameter and a small BET specific surface, the adhesion of the toner to the photoreceptor is weakened; however at the same time, scratches on the photoreceptor increase undesirably.

BRIEF SUMMARY OF THE INVENTION

The present invention has been achieved in consideration of the above-described circumstances, and the first object thereof is to provide a developing agent having a stable charge amount, without causing spent toner or filming on the photoreceptor, creating less scratches on the photoreceptor and having an excellent reproducibility of a half tone, and capable of forming a fine and accurate image in a later stage in its life.

The second object thereof is to provide an image forming apparatus having a stable charge amount of a developing agent in use, without causing spent toner or filming on the photoreceptor, creating less scratches on the photoreceptor and having an excellent reproducibility of a half tone, and capable of forming a fine and accurate image in a later stage in its life.

The third object thereof is to provide an image forming method having a stable charge amount of a developing agent in use, without causing spent toner or filming on the photoreceptor, creating less scratches on the photoreceptor and having an excellent reproducibility of a half tone, and capable of forming a fine and accurate image in a later stage in its life.

First, the present invention provides a developing agent containing a coloring agent, a binder resin, titanium oxide, silica having a BET specific surface area of 10 to 50 $m^2/g$, and metal soap having a volume average grain diameter of 1 to 5 $\mu$m.

Second, the present invention provides an image forming apparatus comprising: an image carrier; a developing unit for storing a developing agent containing a coloring agent, a binder resin, titanium oxide, silica having a BET specific surface area of 10 to 50 $m^2/g$, and metal soap having a volume average grain diameter of 1 to 5 $\mu$m, and for developing a static latent image formed on the image carrier with use of the developing agent so as to form a developing agent image; a transfer unit for transferring the developing agent image; and a fixing unit for fixing a transferred developing agent image.

Third, the present invention provides an image forming method comprising: a static latent image forming step for forming a static latent image on an image carrier; a developing step for developing the static latent image with use of a developing agent containing a coloring agent, a binder resin, titanium oxide, silica having a BET specific surface area of 10 to 50 $m^2/g$, and metal soap having a volume average grain diameter of 1 to 5 $\mu$m, so as to form a developing agent image; a transfer step for transferring the obtained developing agent image on an image-transferred material; and a fixing step for fixing a transferred developing agent image.

According to the present invention, the charge amount of the developing agent in use is stabilized, and less spent toner or filming on the photoreceptor occurs, thus making it possible to form a stable image in a later stage in its life. Further, scratches are not made on the photoreceptor, and therefore an excellent image without scratches in a half tone, can be obtained.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawing, which are incorporated in and constitute a part of the specification, illustrate presently preferred embodiments of the invention, and together with the general description given above and the detailed description of the preferred embodiments given below, serve to explain the principles of the invention.

The single FIGURE is a schematic view showing an example of the image forming apparatus according to the present invention.

DETAILED DESCRIPTION OF THE INVENTION

The developing agent of the present invention is obtained by adding titanium oxide, silica having a BET specific surface area of 10 to 50 $m^2/g$, and metal soap having a volume average grain diameter of 1 to 5 $\mu$m, to toner particles containing a coloring agent and a binder resin.

The image forming apparatus of the present invention includes an image carrier, a developing unit for containing the developing agent, and developing a static latent image formed on the image carrier, thereby forming a developing agent image, a transfer unit for transferring the developing agent image and fixing unit for fixing a transferred developing agent image.

The image forming method of the present invention includes: a static latent image forming step for forming a static latent image on an image carrier; a developing step for developing the static latent image formed on the image carrier with use of the developing agent, thereby forming a developing agent image; a transfer step for transferring the obtained developing agent image on an image-transferred material; and a fixing step for fixing a transferred developing agent image.

As the metal soap, fatty acid non-alkali metal salts such as zinc stearate, calcium stearate, magnesium stearate, aluminum stearate and zinc laurate can be used.

Known examples of preparing the metal soap are a direct method in which a fatty acid and a metal oxide or hydroxide are made to react directly with each other, and a multiple decomposition method in which fatty acid alkali-metal salt and a non-alkali metal salt are made to react with each other to precipitate metal soap. The former is in a grainy state, whereas the latter is in a powder state, and usually, the average grain diameter is 10 $\mu$m or more.

In the case where such metal soap is added to the developing agent, the amount of developing agent stuck on the developing unit or drum is decreased due to the slippery effect of the metal soap, and it is confirmed that the filming or spent toner decreases. However, for a sufficient effect to be obtained, a great amount of metal soap must be added, and consequently, the deterioration of the toner flowability, the decrease in the initial charge amount, the decrease in ID caused by fogging or the lowering of the toner conveying property of the developing unit, and the transportation error in the solid section, which are not desirable, easily occur. Further, the scratches on the drum are not improved, and further due to an adverse effect of the noise created during the development or transfer operation by large-sized grains, a half tone cannot be finely reproduced.

By contrast, metal soap was ground by a jet grinder into particles of smaller diameters than usual, and added to toner, then subjected to a test carried out in a similar manner. In this case, with a small amount of metal soap added, the filming on the drum disappears, or no adverse effects result on the charge characteristics or image characteristics. Thus, it was found that an excellent performance with less spent toner could be achieved when becomes old in its life. Or when metal soap of small grain diameter was used, the friction between the drum and cleaning blade was lowered, thus reducing scratches on the drum. It was further found that the noise caused by large-diameter grains during a transfer or the like, a uniform half tone image could be obtained. Advantages of adding finely ground small-diameter metal soap are the decrease in the adhesiveness of toner itself and an decrease in the friction between the blade and drum.

For fine-grinding of the metal soap, a jet grinder used for grinding ordinary toner can be used. It is not necessary to cool the grinding air in particular. Before the fine-grinding of the toner, it is possible that it is mixed with the metal soap and ground at the same time. The collection may be performed with a cyclone or a bug filter. The grain diameter after the grinding should be 5 $\mu$m or less, otherwise, a sufficient effect as described above cannot be obtained. It should be noted that with the jet grinder, it is practically impossible to grind metal soap into grains of a diameter of 1 $\mu$m or less, in terms of efficiency.

Therefore, the average grain diameter of the metal soap used in the present invention should be 1 to 5 $\mu$m, or preferably, 2 to 45 $\mu$m.

The type of the metal soap used can be selected in accordance with the electronic photographing process employed. Of the general metal soaps, calcium salt entails a large difference in the charge amount in the environment, and the distribution of the charge amount easily becomes broad at low humidity, and magnesium salt is likely to have a large distribution of the 0 charge amount. Under these circumstances, for example, as the metal soap, zinc stearate and aluminum stearate are preferably employed.

The amount of metal soap added is 0.05 to 2% by weight with respect to the weight of toner, preferably, 0.2 to 1% by weight. The addition of the metal soap may be carried out before the grinding of the toner or at the time of mixing with toner particles by a Henschel mixer after grinding. Or in the case of two-component development, the metal soap may be added to the developing agent.

Further, according to the present invention, titanium oxide and silica having a BET specific surface area of 10 to 50 $m^2/g$ are added as attachment at the same time as the above-described metal soap having an average diameter of 1 to 5 $\mu$m, and in this manner, a further flowability is imparted to the developing agent, the spent toner is decreased in amount and the filming on the photoreceptor is prevented. Thus, the distribution of the half tome image, which is caused by a scratch on the photoreceptor, can be avoided, and therefore the charge property can be stabilized, thus improving the life property.

When fine-grain-diameter silica having a BET specific surface area of 50 $m^2/g$ or more is used, the charge amount becomes excessively high, resulting in ID shortage. Further, due to such a small grain diameter, the adhesion property with respect to the photoreceptor becomes strong, thereby easily creating a filming. Furthermore, due to the filling effect to toner, problems such as low heat storage stability and a great amount of spent toner at later stage in life, easily occur. Therefore, silica having relatively large grain diameter is advantageous; however large-grain silica does not very much improve the flowability. In the case of color toner, generally, the electrical resistance tends to be high, and the charge amount tends to be high. Therefore, in the developing agent of the present invention, titanium oxide is added at the same time in order to control these drawbacks.

The BET specific surface area of the silica should preferably be 10 to 50 $m^2/g$. If it exceeds 50 $m^2/g$, there is a tendency of 10, whereas if it is less than 10 $m^2/g$, the flowability tends to decrease and to deteriorate the image quality.

Preferable amounts of these additives are as follows. That is, the amount of titanium oxide added is 0.2 to 2% by weight with respect to the weight of the toner, and the amount of silica having a BET specific surface area of 50 $m^2/g$ or less, is 0.2 to 2% by weight with respect to the weight of the toner, and more preferably, they should be 0.5 to 1.5% by weight and 1.0 to 3.0% by weight, respectively.

As a binder resin used for the developing agent, for example, polyester resin, polystylene resin, stylene/acrylate copolymer resin, polyester-stylene/acrylate hybrid resin, epoxy resin, or polyether/polyol resin can be used.

As a wax, for example, natural wax such as rice wax or carnauba wax, petroleum wax paraffin wax, or synthesized wax such as fatty acid ester, fatty acid amide, low-molecular polyethylene or low-molecular polypropylene can be used.

As a coloring agent, for example, carbon black, organic or inorganic pigment or dye can be used. Although there are no particular limitations, as the carbon black, for example, acetylene black, furnace black, thermal black, channel black or ketchen black can be used solely or in combination. Further, as the pigment and dye, for example, Fast Yellow G, Benzidine Yellow, Indofast Orange, Irgajin Red, Carmine FB, Carmine 6B, Permanent Bordeaux FRR, Pigment Orange R, Lithol Red 2G, Lake Red C, Rhodamine FB, Rhodamine Lake B, Phthalocyanine Blue, Pigment Blue, Brilliant Green B, Phthalocyanine Green, or Quinacridone can be used solely or in combination.

Apart from the above, a charge adjusting agent, an internal/external lubricant, a cleaning auxiliary, a fluidizing agent and the like may be added.

Further, according to the present invention, the method of preparing toner, the manufacturing device and the like are not particularly limited. As a general color-toner manufacturing method, the following method can be employed. That is, with use of resin, pigments and the like, a master batch is prepared, and the master batch, resin, wax, charger adjusting agent and the like are uniformly mixed and kneaded, followed by cooling. Then, the resultant is ground and classified into a predetermined size, and then additives such as silica and titanium oxide, and metal soap having a grain diameter of 1 to 5 $\mu$m are added thereto thus obtaining the toner.

As the formula of the developing agent of the present invention, a two-component developing agent consisting of a toner containing a coloring agent, binder resin and titanium oxide, silica having a BET specific surface area of 10 to 50 $m^2/g$ and metal soap having a volume-average grain diameter of 1 to 5 $\mu$m, and a carrier having a grain diameter of 40 to 70 $\mu$m, and a maximum magnetization of 70 emu/g, is obtained. Then, it is combined with a two-component full-color developing system which carries out development by applying a DC/AC superimposing development bias using means for applying development bias in which DC and Ac are superimposed, for an actual use.

In this manner, the toner is exposed to a vibration electric field while developing, and therefore it is easily separated from the carrier, thus increasing the development efficiency. Therefore, it becomes possible to obtain a sufficient ID at a relatively low development electric field (DC). As a result, the amount of the carrier attached is reduced, thus decreasing scratches on the photoreceptor, and white stripe lines created in a half tone portion. Further, the effect of releasing the aggregation of the developing agent, thus decreasing brushing pattern or irregularity.

The preferable grain diameter of the carrier should be 40 to 70 $\mu$m, and the preferable maximum magnetization is 40 to 70 emu/g.

An example of the full-color electronic photographing device which uses the above-described two-component full-color developing system, will now be described with reference to FIGURE.

In FIGURE, the photoreceptor drum 11 which is an image carrier is a laminate type organic photoreceptor, and provided to be rotatable in the direction indicated by the arrow in the figure.

To surround the photoreceptor drum 11, the following members are provided along the rotating direction. That is, an exposure unit 15 for forming a static latent image by exposing the surface of the photoreceptor drum 11 charged by a charge roller which is not shown, is provided. On a down-stream side of the exposure unit, a developing agent unit 12 having a developing roller 61 connected to a power source 61, is provided, and the developing agent unit contains developing agent. The power source 61 is capable of outputting both AC and DC. The developing agent unit 12 develops a static latent image on the photoreceptor drum 11, with the developing agent while applying a predetermined AC/DC superimposing bias on the developing roller 61 by the power source 61. On the down-stream side of the developing agent unit 12, feeding means 14 for feeding a sheet, which is an image-transferred material, to the photoreceptor drum 21, is provided.

Further, on a further down-stream side of the position on the photoreceptor drum 11 where a sheet is abutted, a blade cleaning device 13 and a de-electrifying lamp which is not shown are provided.

The feeding means 14 has a width substantially the same as the drum width of the photoreceptor drum 11. The feeding means 14 has a form of a ring belt, and a tension roller 17 and a drive roller 18 are respectively provided on ring portions of the up-stream side and down-stream side of the feeding means 14. The feeding means 14 is brought into contact with the tension roller 17 and the drive roller 18 such that it is set along the outer circumferences of the tension roller 17 and the drive roller 18 in these ring portions.

The tension roller 17 and the drive roller 18 are provided to be rotatable in the directions indicated by arrows, respectively in the figure. As the drive roller 18 rotates, the feeding means 14 is conveyed in a ring-like manner. The feeding speed is controlled to synchronize with the rotating speed of the photoreceptor.

The photoreceptor drum 11, the exposure unit 15, the developing agent unit 12 and the blade cleaning device 13 and the de-electrifying lamp 16 constitute a process unit 100.

On the feeding means 14 between the tension roller 17 and the drive roller 18, the process unit 100, a process unit 200, a process unit 300 and a process unit 400 are provided along the feeding direction. All of the process unit 200, process unit 300 and process unit 400 have the same structure as that of the process unit 100.

More specifically, the photoreceptor drum 1, a photoreceptor drum 21, a photoreceptor drum 31 or a photoreceptor drum 41 are provided at substantially the center of the respective process unit. To surround these photoreceptor drums, an exposure unit 25, an exposure unit 35 and an exposure unit 45 are provided respectively, and further, on a down-stream side, a developing agent unit 22 having a developing roller 62 connected to a power source 52, a developing agent unit 32 having a developing roller 63 connected to a power source 53 and a developing agent unit 42 having a developing roller 64 connected to a power source 54, and a blade cleaning device 23, and a blade cleaning device 33 and a blade cleaning device 43, are respectively provided, as in the case of the process unit 100.

The process units are only different from each other in terms of the developing agent contained in the developing agent unit. For example, the developing agent unit 12 contains a developing agent containing a yellow coloring agent, the developing agent unit 22 contains a developing agent containing a magenta coloring agent, the developing agent unit 32 contains a developing agent containing a cyan coloring agent, and the developing agent unit 42 contains a developing agent containing a black coloring agent. Each of the developing agents consists of a toner containing the respective coloring agent, a binder resin, titanium oxide, silica having a BET specific surface area of 50 $m^2/g$ or less and metal soap having a volume-average grain diameter of 5 $\mu$m or less, and a carrier having a grain diameter of 70 $\mu$m or less and a maximum magnetization of 70 emu/g or less.

When outputting a color image, a sheet fed on the feeding means 14 are brought into contact with the photoreceptor drums 1, 21, 31 and 41 one after another in the mentioned order. At the contact positions between the sheet and each of the photoreceptor drums 11, 21, 31 and 41, charge rollers 19, 29, 39 and 49 serving as transfer means are provided to correspond to the photoreceptor drums 11, 21, 31 and 41, respectively one by one.

The charge rollers 19, 29, 39 and 49 are provided at the respective contact positions of the respective photoreceptor drums such that the back surfaces thereof are brought into contact with the feeding member 14, and thus they are arranged to oppose to the respective photoreceptor drums via the feeding means 14. It should be noted that the charge rollers 19, 29, 39 and 49 are connected to the bias power sources which are not shown. The charge rollers 19, 29, 39 and 49 are designed to rotate to follow up the movement of the feeding means 14.

Here, the image forming process by the imaging forming device having the above-described structure will now be described.

The photoreceptor drums 11, 21, 31 and 41 which rotate separately in the respective four process units are uniformly charged at 500V by charging means (not shown) to which an AD superimposing DC bias is applied.

The photoreceptor drums 11, 21, 31 and 41 charged uniformly are irradiated with light by the exposure units 15, 25, 35 and 45, which perform exposure by phosphors, and thus a static latent image is formed. For this static latent image, AC interposing DC biases having AD peak-peak value of 500 to 1500V, DC of 150 to 450V, and DC peak-peak value of 2 to 6 kHz are applied respectively to the developing agent rollers 61, 62, 63 and 64 by the respective power sources 51, 52, 53 and 54. Thus, the image is developed by developing agents of respective colors which are sufficiently charged in advance.

In the meantime, a sheet is sent from a sheet-feeding cassette (not shown) to an image transfer position of the photoreceptor drum 11.

When the sheet is fed to the transfer position, a voltage of, for example, about 1400V is applied as a bias voltage, to the feeding means 14 from the charge rollers 19, 29, 39 and 49. With the application of the bias voltage, a transfer electric field is created between the photoreceptor drums 11, 21, 31 and 41 and the feeding means 14. Therefore, first, a developing agent image on the photoreceptor drum 11 is transferred on a sheet, and the sheet which carries the developing agent image is conveyed and reaches the photoreceptor drum 21. A developing agent image formed on the photoreceptor drum 21 is further superimposed on the first transferred developing agent image and transferred thereon. The sheet is further conveyed and developing agent images of different colors are similarly transferred on the sheet in the photoreceptor drums 31 and 41.

Thus, the sheet which carries an image formed by the multiple transferring method is fed from the feeding means 14 to the fixing unit 115. The fixing unit 15 has a heat roller 135 and a press roller 145. As the sheet is passed between the heat roller and press roller, the transferred image is also passed therebetween while making a contact with the heat roller, thus being fixed on the sheet.

It should be noted that the image forming apparatus is merely an example of the present invention, and the invention can be applied also to, for example, a full-color image forming apparatus in which a single photoreceptor drum and a plurality of developing agent units are combined, and a monochrome image forming apparatus in which a single photoreceptor drum and a single developing agent unit are combined.

EXAMPLES

The present invention will now be described with reference to examples.

Example 1

First, in order to metal soap having a grain diameter of 5 μm, zinc stearate (grain diameter: 12 μm) of NOF Corporation was finely ground with use of a jet grinder, LABO JET, of Japan Pneumatic Co. under conditions of a grinding air pressure of 5.0 kg/cm$^2$, and feeding speed of 0.2 kg/H. Thus ground product had a volume-average grain diameter of 4 μm.

As the prescription of the toner, first, 30 parts by weight of azo-based magenta pigment (Pigment Red 184) and 70 parts by weight of polyester resin were kneaded by a pressure coder, and then a master batch of a magenta pigment was prepared via two rolls.

10 parts by weight of thus obtained magenta pigment master batch, 83 parts by weight of polyester resin, 6 parts by weight of Rice Wax LAX-N-100A (NN Chemical Co. Limited: a boiling point of 79° C., a kinetic viscosity at 100° C. of 18cSt), and 1 part by weight of TN-105 (Hodoya Chemicals Co.) as CCA were mixed uniformly by a Henschel mixer, and kneaded by a two-axis extruder PCM45, followed by cooling and roughly grinding. Further, with use of a jet grinder, the rough grain was finely grained, and the fine grain was eliminated by an airflow classifier, thus obtaining magenta toner having a volume of 50% and a grain diameter of 8.0 μm.

Further, 100 parts by weight of thus obtained magenta toner, 2 parts by weight of silica fine powder (hydrophobic silica NAX50 of Nihon Aerozil: BET specific surface ratio of 40 m$^2$/g), 1 part by weight of titanium oxide fine powder (STT-30A of Titan Kogyo K.K.) and 0.5 parts by weight of zinc stearate prepared as above were mixed by a Henschel mixer for 3 minutes, and then sifted with a 200-mesh sifter, thus obtaining two-component negatively charged magenta toner.

Thus obtained magenta toner was mixed with a carrier EFCS1–6 of Powder Tech Co. (having an average grain diameter of 60 μm and a maximum magnetization of 64 emu/g) at a toner ratio concentration of 5.5%, thus forming a developing agent, and the developing agent was put in the digital full-color copier FC-22 of Toshiba Tech. Then, images obtained were measured. The result indicated that clear magenta image could be obtained. Further, the initial ID was 1.80 and the charge amount was 4.0 fento-C/10 μm at Q/d (measured by Espurt analyzer of Hosokawa Micron Co.). Further, sixty thousand sheets were subjected to the test, and in each case, an image with excellent image density and fogging was obtained and the scattering of toner was excellent. After the sixty thousand sheets, the charge amount was 3.8. Further, there was no filming formed on the photoreceptors, and images free of half tone or scratches were obtained.

Further, the toner was put in a polyethylene container, and immersed in a hot water bath maintained at 55° C. at all times for 8 hours. After that, the toner was taken out of the polyethylene container, and observed. The result indicated that there was no aggregation of toner and an excellent heat preservation storage property was exhibited.

Comparative Example 1

Toner was prepared in the same manner as above except that zinc stearate was not used, and the obtained toner was evaluated. The initial ID was 1.75 and the charge amount was 4.5 at Q/d. Further, after sixty thousand sheets subjected to the test, the image density maintained 1.8, and there were no problem regarding the fogging or the scattering of toner. However, the filming on the photoreceptor started to be created after ten thousand sheet, and therefore the half tones of images included a lot of scratches. After sixty thousand sheets, the charge amount was 3.6.

Comparative Example 2

Toner was prepared in the same manner as in Example 1 except that 0.5 parts by weight of not-yet-ground zinc stearate having a volume-average grain diameter of 12 μm was used in place of zinc stearate having a volume average grain diameter of 4.0 μm, and the obtained toner was evaluated.

The initial ID was 1.85 and the charge amount was 3.5 at Q/d, with no problem in fogging. Further, after sixty thousand sheets subjected to the test, the image density was lowered to 1.5, and the fogging and the scattering of toner slightly increased. Further, after ten thousand sheets, the developing agent feeding error started to occur, thus making the solid image non-uniform. After sixty thousand sheets, the charge amount was 3.9. The filming on the photoreceptor started after thirty thousand sheets; however, the half tones of images included a lot of scratches.

Comparative Example 3

Toner was prepared in the same manner as in Comparative Example 2 except that 1.0 part by weight of not-yet-ground zinc stearate having a volume-average grain diameter of 12 μm was used in place of zinc stearate having a volume average grain diameter of 4.0 μm, and the obtained toner was evaluated.

The initial ID was 1.90 and the charge amount was 3.0 at Q/d, with a little bit of fogging. Further, after sixty thousand sheets subjected to the test, the image density was lowered to 1.3, and the fogging and the scattering of toner increased. Further, after five thousand sheets, the solid image became non-uniform. After sixty thousand sheets, the charge amount was 4.5. The filming on the photoreceptor did not start until after sixty thousand sheets; however, the half tones of images included a lot of scratches.

Example 2

Toner was prepared in the same manner as in Example 1 except that 0.5 part by weight of aluminum stearate ground to have a volume-average grain diameter of 4.0 μm was added in place of zinc stearate, and the obtained toner was evaluated in the same manner. As a result, a clear magenta image was obtained.

The initial ID of the toner was 1.78 and the charge amount was 4.2 at Q/d. Further, after sixty thousand sheets subjected to the test, the image density and the fogging were excellent, and the scattering of toner was good. After sixty thousand sheets, the charge amount was 3.8. There was no filming created on the photoreceptor, and images having half tones free of scratches were obtained.

Further, the toner was put in a polyethylene container, and immersed in a hot water bath maintained at 55° C. at all times for 8 hours. After that, the toner was taken out of the polyethylene container, and observed. The result indicated that there was no substantial aggregation of toner and an excellent heat preservation storage property was exhibited.

Comparative Example 4

Toner was prepared in the same manner as in Example 1 except that 1.0 part by weight of hydrophobic silica R-972 of Nihon Aerozil (BET specific surface ratio of 110 $m^2/g$) was used in place of 2 parts by weight of hydrophobic silica NAX50 of Nihon Aerozil (BET specific surface ratio of 40 $m^2/g$), and the obtained toner was evaluated in the same manner. As a result, a clear magenta image was obtained.

The initial ID of the toner was slightly low as 1.74 and the charge amount was 4.3 at Q/d. Further, after sixty thousand sheets subjected to the test, the image density was lowered to 1.60; however, the fogging and the scattering of toner were good. After sixty thousand sheets, the charge amount was 4.5. After, thirty thousand sheets, a filming was created on the photoreceptor.

Further, the toner was put in a polyethylene container, and immersed in a hot water bath maintained at 55° C. at all times for 8 hours. After that, the toner was taken out of the polyethylene container, and observed. The result indicated that aggregation of toner occurred.

As presented by Examples 1 and 2, the developing agent of the present invention has a stable charge amount and a good heat preservation storage property is exhibited. When image formation is carried out with use of the developing agent of the present invention, there will be a less amount of spent toner, or no filming is created on the photoreceptor. In a later stage in its life, the image is stabilized, and further no scratch is created on the photoreceptor. Therefore, a high-quality image having a half tone without scratches can be obtained.

Example 3

Toner was prepared in the same manner as in Example 1 except that 0.2 part by weight of zinc stearate was added, and the obtained toner was evaluated in the same manner. As a result, a clear magenta image was obtained.

The initial ID of the toner was 1.79 and the charge amount was 4.2 at Q/d. Further, after sixty thousand sheets subjected to the test, the image density and the fogging were good, and the scattering of toner was good as well. After sixty thousand sheets, the charge amount was 4.0. Slight filming was created on the photoreceptor, and a few scratches were made in a half tone; however an image of a certain level, which has no particular problem, was obtained.

Further, the toner was put in a polyethylene container, and immersed in a hot water bath maintained at 55° C. at all times for 8 hours. After that, the toner was taken out of the polyethylene container, and observed. The result indicated that aggregation of toner occurred, and the heat preservation storage property was good.

Example 4

Toner was prepared in the same manner as in Example 1 except that 1.0 part by weight of zinc stearate was added, and the obtained toner was evaluated in the same manner. As a result, a clear magenta image was obtained.

The initial ID of the toner was 1.82 and the charge amount was 3.7 at Q/d. Further, after sixty thousand sheets subjected to the test, the image density and the fogging were good, and the scattering of toner was good as well. The conveying property of the developing agent was slightly lowered and the image density was slightly lowered; however an image of a certain level, which has no particular problem, was obtained. After sixty thousand sheets, the charge amount was 3.5. Also, a high-quality image having no filming created on the photoreceptor, or without scratches made in a half tone was obtained.

Further, the toner was put in a polyethylene container, and immersed in a hot water bath maintained at 55° C. at all times for 8 hours. After that, the toner was taken out of the polyethylene container, and observed. The result indicated that aggregation of toner occurred, and the heat preservation storage property was good.

TABLE 1

List of Results of Examples

| | | Sample | Life ID | fog scattering | filming | scratch | conveying property |
|---|---|---|---|---|---|---|---|
| Example 1 | ZnSt<br>NAX50 2% | 4/Lm 0.5%<br>titanium oxide 1% | ○ | ○ | ○ | ○ | ○ |
| Comparative Example 1 | ZnSt<br>NAX50 2% | without<br>titanium oxide 1% | ○ | ○ | xx | xx | ○ |
| Comparative Example 2 | ZnSt<br>NAX50 2% | 12 μm 0.5%<br>titanium oxide 1% | Δ | Δ | x | xx | x |
| Comparative Example 3 | ZnSt<br>NAX50 2% | 12 μm 1.0%<br>titanium oxide 1% | x | x | ○ | x | xx |
| Example 2 | ZnAl<br>NAX50 2% | 4 μm 0.5%<br>titanium oxide 1% | ○ | ○ | ○ | ○ | |
| Comparative Example 4 | ZnSt<br>R972 1% | 4 μm 0.5%<br>titanium oxide 1% | Δ | ○ | x | ○ | ○ |
| Example 3 | ZnSt<br>NAX50 2% | 4 μm 0.2%<br>titanium oxide 1% | ○ | ○ | Δ | Δ | ○ |
| Example 4 | ZnSt<br>NAX50 2% | 4 μm 1.0%<br>titanium oxide 1% | Δ | ○ | ○ | ○ | Δ |

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A developing agent comprising:

a coloring agent;

a binder resin;

titanium oxide;

silica having a BET specific surface area of 10 to 50 $m^2/g$; and metal soap having a volume average grain diameter of 1 to 5 $\mu m$.

2. A developing agent according to claim 1, further comprising a carrier having a grain diameter of 40 to 70 $\mu m$ and a maximum magnetization of 40 to 70 emu/g, said developing agent used in combination with a two-component full color developing system for carrying out a development by applying a development bias in which a DC and an AC are superimposed.

3. A developing agent according to claim 1, wherein the silica has a BET specific surface area of 10 to 50 $m^2/g$, and the metal soap has a volume average grain diameter of 1 to 5 $\mu m$.

4. A developing agent according to claim 1, wherein the carrier has a grain diameter of 40 to 70 $\mu m$ and a maximum magnetization of 40 to 70 emu/g.

5. A developing agent according to claim 1, wherein the metal soap is at least one type of fatty acid non-alkali metal salt selected from a group consisting of zinc stearate, calcium state, magnesium stearate, aluminum stearate and zinc laurate.

6. A developing agent according to claim 1, wherein the amount of the metal soap added is 0.05% by weight to 2% by weight.

7. An image forming apparatus comprising:

an image carrier;

a developing unit for storing a developing agent containing a coloring agent, a binder resin, titanium oxide, silica having a BET specific surface area of 10 to 50 $m^2/g$, and metal soap having a volume average grain diameter of 1 to 5 $\mu m$, and for developing a static latent image formed on the image carrier with use of the developing agent so as to form a developing agent image;

a transfer unit for transferring the developing agent image; and a fixing unit for fixing a transferred developing agent image.

8. An image forming apparatus according to claim 7, wherein the developing agent unit further comprises means for applying a development bias in which a DC and an AC are superimposed, and the developing agent further contains a carrier having a grain diameter of 40 to 70 $\mu m$ and a maximum magnetization of 40 to 70 emu/g.

9. An image forming apparatus according to claim 7, wherein the silica has a BET specific surface area of 10 to 50 $m^2/g$, and the metal soap has a volume average grain diameter of 1 to 5 $\mu m$.

10. An image forming apparatus according to claim 7, wherein the carrier has a grain diameter of 40 to 70 $\mu m$ and a maximum magnetization of 40 to 70 emu/g.

11. An image forming apparatus according to claim 7, wherein the metal soap is at least one type of fatty acid non-alkali metal salt selected from a group consisting of zinc stearate, calcium state, magnesium stearate, aluminum stearate and zinc laurate.

12. An image forming apparatus according to claim 7, wherein the amount of the metal soap added is 0.05% by weight to 2% by weight.

13. An image forming method comprising:

a static latent image forming step for forming a static latent image on an image carrier;

a developing step for developing the static latent image with use of a developing agent containing a coloring agent, a binder resin, titanium oxide, silica having a BET specific surface area of 10 to 50 $m^2/g$, and metal soap having a volume average grain diameter of 1 to 5 $\mu m$, so as to form a developing agent image;

a transfer step for transferring the obtained developing agent image on an image-transferred material; and a fixing step for fixing a transferred developing agent image.

14. An image forming method according to claim 13, wherein the developing step is carried out while applying a development bias in which a DC and an AC are superimposed, and the developing agent further contains a carrier having a grain diameter of 40 to 70 $\mu m$ and a maximum magnetization of 40 to 70 emu/g.

15. An image forming method according to claim 13, wherein the silica has a BET specific surface area of 10 to 50 $m^2/g$, and the metal soap has a volume average grain diameter of 1 to 5 $\mu m$.

16. An image forming method according to claim 13, wherein the carrier has a grain diameter of 40 to 70 $\mu m$ and a maximum magnetization of 40 to 70 emu/g.

17. An image forming method according to claim 13, wherein the metal soap is at least one type of fatty acid non-alkali metal salt selected from a group consisting of zinc stearate, calcium state, magnesium stearate, aluminum stearate and zinc laurate.

18. An image forming apparatus according to claim 13, wherein the amount of the metal soap added is 0.05% by weight to 2% by weight.

* * * * *